US006922933B1

(12) United States Patent
Davis

(10) Patent No.: US 6,922,933 B1
(45) Date of Patent: Aug. 2, 2005

(54) PRIMER REMOVAL TOOL

(75) Inventor: Terry L. Davis, Yuma, AZ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 152 days.

(21) Appl. No.: 10/719,091

(22) Filed: Nov. 24, 2003

(51) Int. Cl.[7] ..... F41A 15/00
(52) U.S. Cl. ..... 42/90; 42/95; 89/1.1; 81/463
(58) Field of Search ..... 42/51, 90, 95; 408/120, 122, 138, 139; 81/3.05, 463, 124.2; 86/21, 28, 33, 1.1; 89/1.1; 15/104.18

(56) References Cited

U.S. PATENT DOCUMENTS 2,314,115 A * 3/1943 Albree ..... 86/37
2,661,641 A * 12/1953 Wood, Jr. ..... 408/76
2,985,899 A * 5/1961 Elliott ..... 408/222
3,208,302 A * 9/1965 Lewis ..... 74/548
3,283,643 A * 11/1966 Mittelsteadt ..... 86/36
3,564,950 A * 2/1971 Jorczak et al. ..... 81/3.05
3,745,875 A * 7/1973 Kennedy ..... 86/23
3,972,222 A * 8/1976 Yonkers et al. ..... 73/12.08
3,982,465 A * 9/1976 Schabauer ..... 86/36
4,149,820 A * 4/1979 Newlin ..... 408/120
4,383,469 A * 5/1983 MacMillan ..... 86/10
4,407,086 A * 10/1983 Hasselmann ..... 42/90
4,442,619 A * 4/1984 McCarley ..... 42/90
4,449,868 A * 5/1984 Steinsberger et al. ..... 408/138
4,458,415 A * 7/1984 Maher et al. ..... 30/164.6
4,573,378 A * 3/1986 McDonald ..... 81/463
4,785,692 A * 11/1988 Holmes ..... 81/27
4,807,511 A * 2/1989 Markle ..... 86/24
4,856,946 A * 8/1989 Park ..... 408/122
4,865,493 A * 9/1989 Miller ..... 408/1 R
4,978,257 A * 12/1990 Nowman ..... 408/111
5,025,556 A * 6/1991 Stafford ..... 29/888.011
5,095,784 A * 3/1992 Garver ..... 81/466
5,131,794 A * 7/1992 Johnson ..... 408/139
5,152,642 A * 10/1992 Pitts et al. ..... 408/226
H1130 H 1/1993 Place et al. ..... 86/24
5,204,483 A * 4/1993 Tellechea ..... 42/95
5,225,614 A * 7/1993 Harchar ..... 42/90
5,236,289 A * 8/1993 Salyer ..... 408/127
5,307,583 A * 5/1994 Mahn et al. ..... 42/51
5,354,154 A * 10/1994 Hartley ..... 408/139
5,404,666 A * 4/1995 Cline, Jr. ..... 42/90
5,415,502 A * 5/1995 Dahlin ..... 408/72 B (Continued)

FOREIGN PATENT DOCUMENTS

GB 2244798 * 11/1991

*Primary Examiner*—Michael J. Carone
*Assistant Examiner*—John Richardson
(74) *Attorney, Agent, or Firm*—Alan P. Klein

(57) ABSTRACT

A primer removal tool comprising a starter tap, a holder for the starter tap, one or more setscrews passing through the holder and against the starter tap for securing the starter tap in the holder, a handle, a spacer bushing connected to the center of the handle, a shaft having one end connected to the starter tap holder and the other end connected to the spacer bushing, and a knurled slider on the shaft, the slider being constrained to slide between the holder and the spacer bushing. The starter tap is inserted into the center of the damaged primer; the tool is held parallel to the centerline of the cannon bore while applying forward pressure; the handle of the tool is rotated clockwise to run the tap into the primer a few turns; and the handle of the tool is rotated counter-clockwise one-quarter of a turn. These steps are repeated until most of the tap is in the primer chamber. Next, the slider is gripped, pushed forward toward the primer chamber, and then quickly pulled backward against the spacer bushing. This motion is repeated until the damaged primer comes out of the primer chamber on the edge of the tap.

11 Claims, 7 Drawing Sheets

U.S. PATENT DOCUMENTS 5,462,392 A * 10/1995 Hardwick ..... 408/76
5,526,722 A * 6/1996 Limehouse ..... 81/466
5,573,357 A * 11/1996 Mirles ..... 408/1 R
5,698,809 A * 12/1997 Holt ..... 86/24
5,700,291 A * 12/1997 Kuslich et al. ..... 606/96
5,984,594 A * 11/1999 Osborne et al. ..... 408/1 R
6,032,398 A * 3/2000 Carpenteri et al. ..... 42/90
6,374,708 B1 * 4/2002 Kunz ..... 81/124.2
6,386,804 B1 * 5/2002 Johnson et al. ..... 408/221
6,435,781 B1 * 8/2002 Jones ..... 408/1 R
6,499,918 B1 * 12/2002 Murphy ..... 408/87
6,558,088 B1 * 5/2003 Day et al. ..... 408/1 R
6,569,022 B2 * 5/2003 Johnson et al. ..... 470/96
6,647,653 B1 * 11/2003 Hengstenberg ..... 42/51

* cited by examiner

PRIMER REMOVAL TOOL

BACKGROUND OF THE INVENTION

This invention relates in general to ordnance and more particularly, to removal of used primers from guns.

To fire a cannon, a projectile is loaded into the firing chamber of the cannon, and a primer is inserted into the primer chamber. When the cannon is fired, the firing pin strikes the primer, which in turn ignites the charge, propelling the projectile through the barrel of the cannon Because of pressures developed by a charge, when a large charge is fired, the primer can fail. The excess pressure can cause the base of the primer to be blown completely off, making removal of the used primer impossible. Since the next projectile cannot be fired, the cannon is rendered useless. The cannon must be taken apart and the spindle removed and taken to a location where the primer can be machined out. This is not an option during battle.

SUMMARY OF THE INVENTION

It is therefore an object of this invention to remove a damaged primer quickly and easily at the cannon's location.

This and other objects of the invention are achieved in one aspect by a tool for removing a damaged primer from the primer chamber of a cannon. The tool comprises a starter tap, means for running the tap into the damaged primer, and means for shaking the damaged primer loose from the primer chamber so that the damaged primer comes out of the primer chamber on the edge of the tap.

Another aspect of the invention involves a method for removing a damaged primer from the primer chamber of a cannon with a tool comprising the steps of running a starter tap into a damaged primer, and shaking the damaged primer loose from the primer chamber so that the damaged primer comes out of the primer chamber on the edge of the tap.

Additional advantages and features will become more apparent as the subject invention becomes better understood by reference to the following detailed description when considered in conjunction with the accompanying drawings wherein:

DETAILED DESCRIPTION

Figure 1:
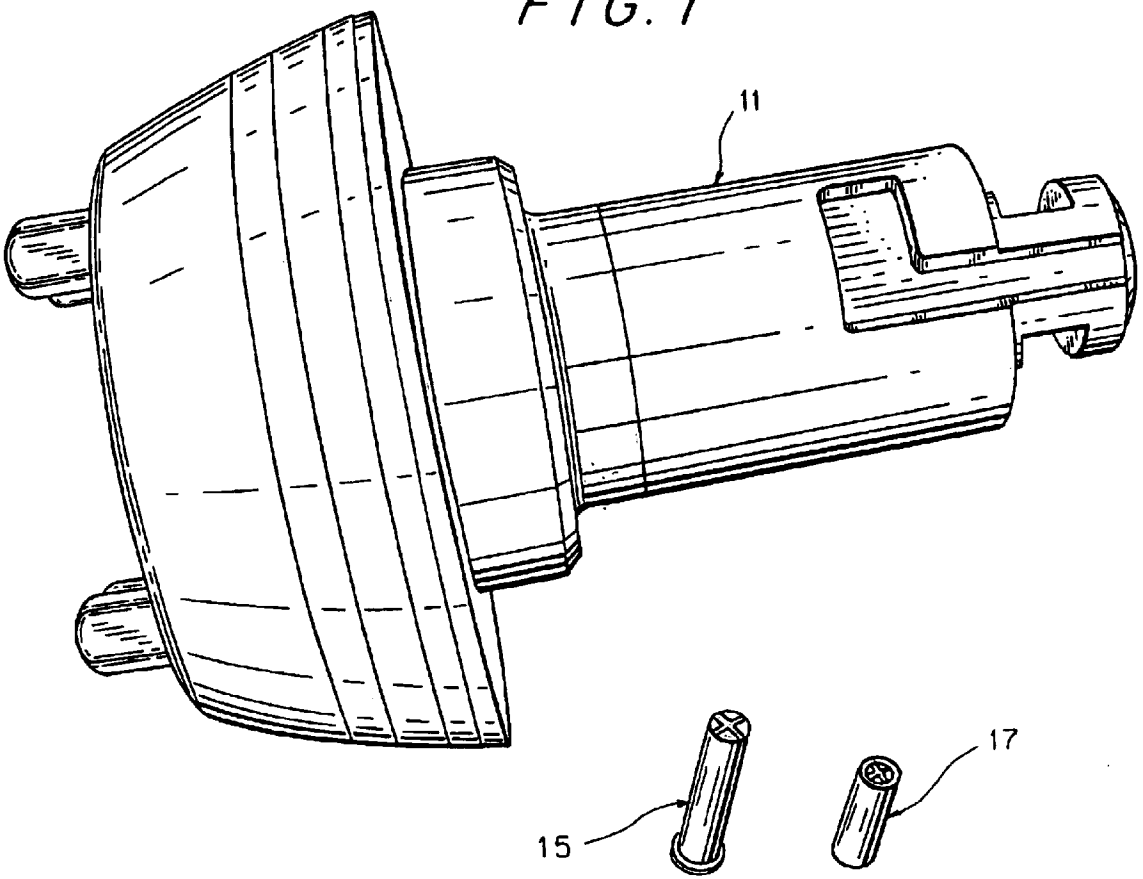
FIG. 1 is a view of a spindle and primers.
Figure 2:
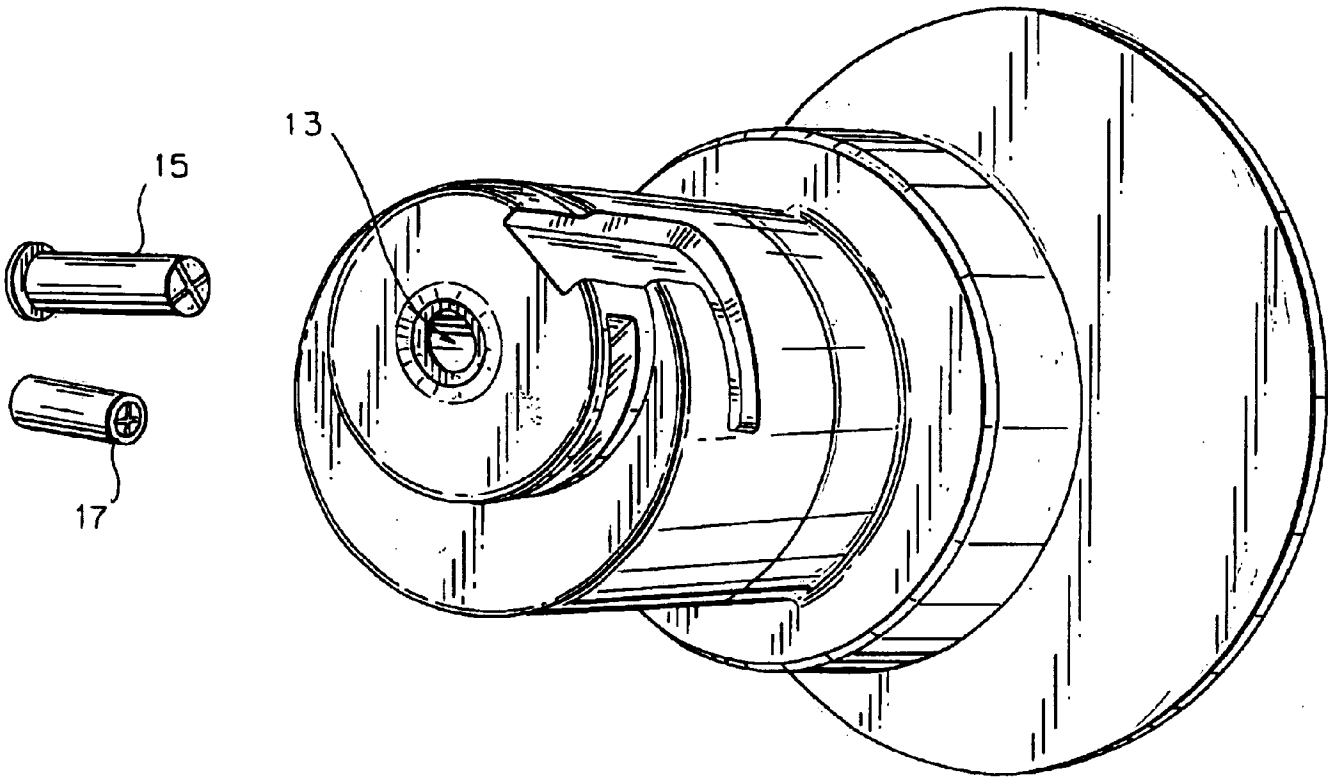
FIG. 2 is another view of a spindle and primers.
Figure 3:
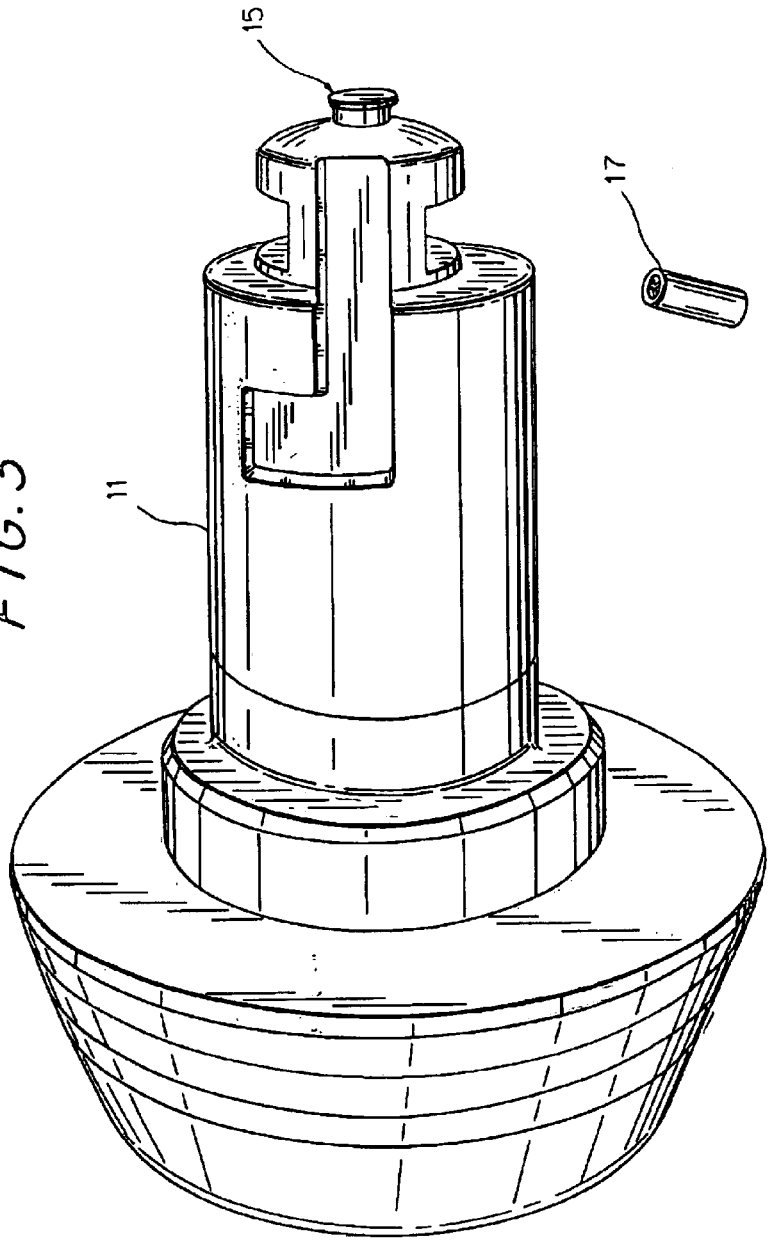
FIG. 3 is a view of a spindle containing a good primer.
Figure 4:
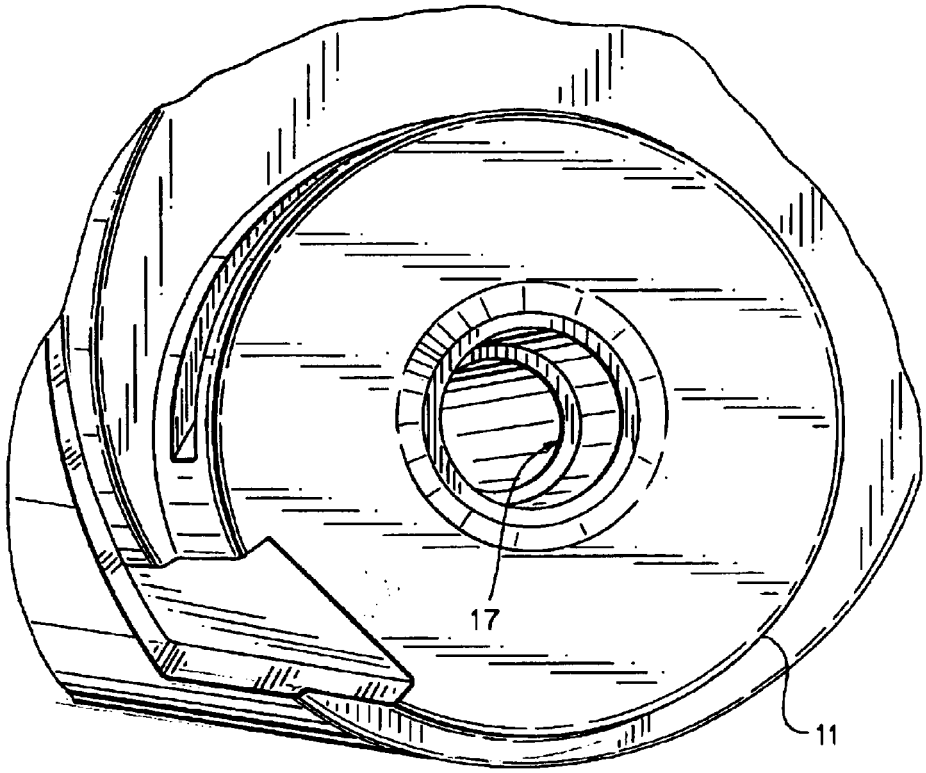
FIG. 4 is a view of a spindle containing a damaged primer.

Referring now to the drawings, wherein like reference numerals designate identical or corresponding parts, FIGS. 1–2 show different views of the spindle 11 of a cannon containing a primer chamber 13. Also shown are a good primer 15, and a damaged primer 17 whose base has been blown off. FIG. 3 shows the good primer 15 in the primer chamber 13. FIG. 4 shows the damaged primer 17 in the primer chamber 13.

Figure 5:
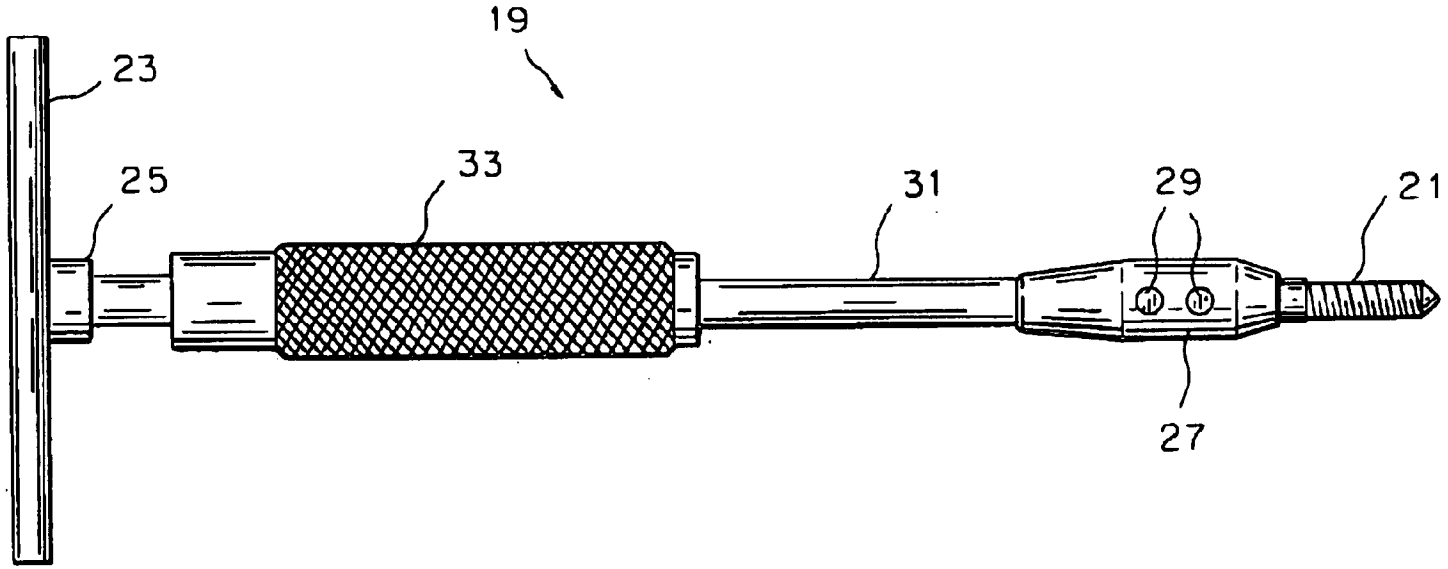
FIG. 5 shows a tool according to the invention.

FIG. 5 shows the tool 19 for removing the damaged primer 17 from the primer chamber 13 of a cannon. The tool 19 comprises a starter tap 21, means for running the tap into the damaged primer 17, and means for shaking the damaged primer loose from the primer chamber 13 so that the damaged primer comes out of the primer chamber on the edge of the tap.

While the means for running the tap into the damaged primer may take a variety of forms, conveniently it may take the form of a handle 23, a spacer bushing 25 connected to the center of the handle, a holder 27 for the tap, one or more setscrews 29 passing through the holder and against the starter tap for securing the tap in the holder, and a shaft 31 having one end connected to the holder and the other end connected to the spacer bushing.

While the means for shaking the damaged primer loose from the primer chamber may take a variety of forms, conveniently it may take the form of a knurled slider 33 on the shaft, the slider being constrained to slide between the holder 27 and the spacer bushing 25.

Figure 6:
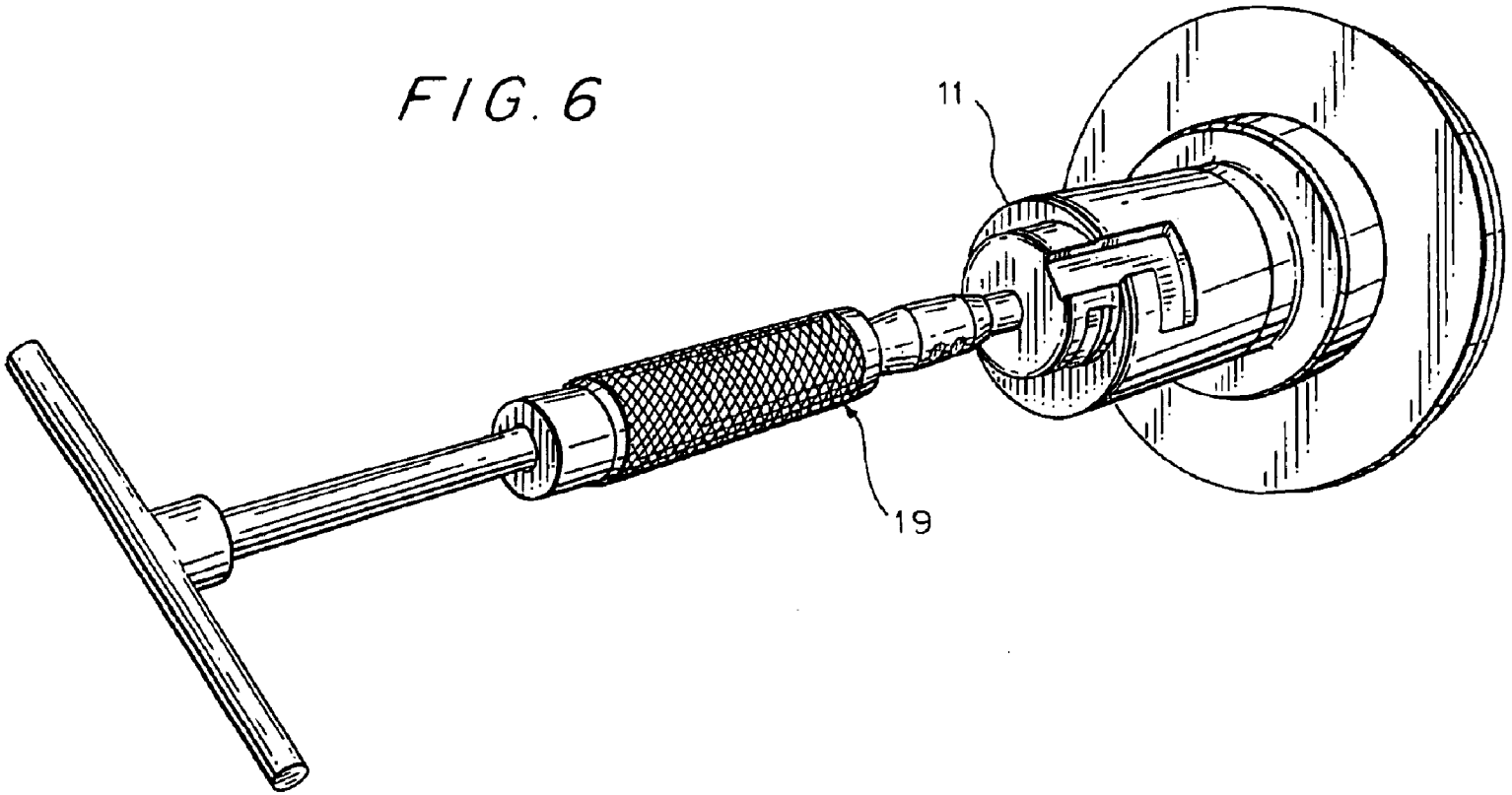
FIG. 6 shows the tool of FIG. 5 tapped into a damaged primer.
Figure 7:
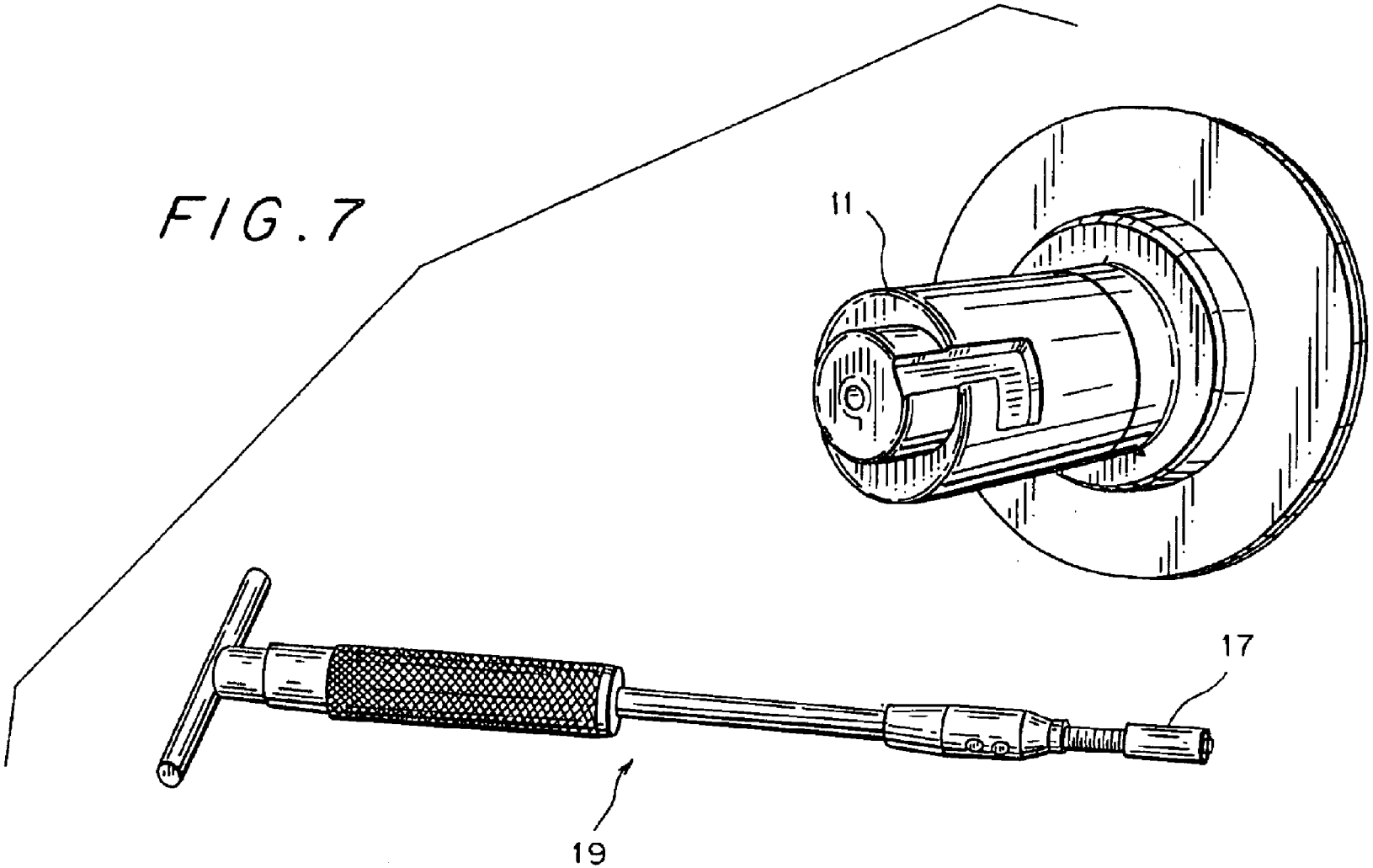
FIG. 7 shows the tool of FIG. 5 after removing the damaged primer.

In operation of the tool 19, the tap 21 is run into the damaged primer 17 (FIG. 6), and the damaged primer is shaken loose from the primer chamber 13 so that the damaged primer comes out of the primer chamber n the edge of the tap (FIG. 7). More specifically, the starter tap 21 is inserted into the center of the damaged primer 17; the tool 19 is held parallel to the centerline of the cannon bore while applying forward pressure; the handle 23 of the tool is rotated clockwise to run the tap into the primer a few turns; and the handle of the tool is then rotated counterclockwise one-quarter of a turn. These steps are repeated until most of the tap is in the primer chamber 13. Next, the slider 33 is gripped; the slider is pushed forward toward the primer chamber 13; and then the slider is quickly pulled backward against the spacer bushing 25. This motion is repeated until the damaged primer 17 comes out of the primer chamber 13 on the edge of the tap 21.

It is obvious that many modifications and variations of the present invention are possible in light of the above teachings. It is therefore to be understood that within the scope of the appended claims, the invention may be practiced otherwise than as described.

What is claimed as new and desired to be secured by Letters Patent of the United States is:

1. A tool for removing a damaged primer from the primer chamber of a cannon comprising:

a starter tap;

means for running the tap into the damaged primer; and means for shaking the damaged primer loose from the primer chamber so that the damaged primer comes out of the primer chamber on the edge of the tap.

2. The tool recited in claim 1 wherein the running means includes:

a handle.

3. The tool recited in claim 2 wherein the running means includes:

a spacer bushing connected to the handle.

4. The primer tool recited in claim 3 wherein the running means includes:

a holder for the starter tap.

5. The tool recited in claim 4 wherein the running means includes:

a shaft having one end connected to the starter tap holder and the other end connected to the spacer bushing.

6. The tool recited in claim 5 wherein the running means includes:

a set screw passing through the holder and against the starter tap for securing the starter tap in the holder.

7. The tool recited in claim 5 wherein the shaking means includes:

a slider on the shaft.

8. The tool recited in claim 7 wherein the slider is constrained to slide between the holder and the spacer bushing.

9. The tool recited in claim 1 in combination with a primer.

10. A primer removal tool comprising:

a starter tap;

a holder for the starter tap;

at least one setscrew passing through the holder and against the starter tap for securing the starter tap in the holder;

a handle;

a spacer bushing connected to the center of the handle;

a shaft having one end connected to the holder and the other end connected to the spacer bushing; and a knurled slider on the shaft, the slider being constrained to slide between the holder and the spacer bushing.

11. The primer tool recited in claim 10 in combination with a primer.

* * * * *